US010181390B2

(12) United States Patent
Takahashi et al.

(10) Patent No.: US 10,181,390 B2
(45) Date of Patent: Jan. 15, 2019

(54) X-RAY TUBE INCLUDING SUPPORT FOR LATITUDE SUPPLY WIRES

(71) Applicant: Toshiba Electron Tubes & Devices Co., Ltd., Otawara-shi (JP)

(72) Inventors: Naoki Takahashi, Nasushiobara (JP); Takashi Shimono, Nasushiobara (JP); Hidero Anno, Otawara (JP)

(73) Assignee: Toshiba Electron Tubes & Devices Co., Ltd., Otawara-shi (JP)

( * ) Notice: Subject to any disclaimer, the term of this patent is extended or adjusted under 35 U.S.C. 154(b) by 73 days.

(21) Appl. No.: 15/152,992

(22) Filed: May 12, 2016

(65) Prior Publication Data

US 2016/0365218 A1 Dec. 15, 2016

(30) Foreign Application Priority Data

Jun. 10, 2015 (JP) ..... 2015-117322

(51) Int. Cl.
*H01J 1/18* (2006.01)
*H01J 5/26* (2006.01)
(Continued)

(52) U.S. Cl.
CPC ..... *H01J 35/165* (2013.01); *H01J 1/18* (2013.01); *H01J 5/22* (2013.01); *H01J 5/26* (2013.01);
(Continued)

(58) Field of Classification Search
CPC ..... H01J 1/00; H01J 1/02; H01J 1/13; H01J 1/15; H01J 1/16; H01J 1/18; H01J 1/88;
(Continued)

(56) References Cited

U.S. PATENT DOCUMENTS 2,036,069 A * 3/1936 Morrison ..... H01J 19/42 200/48 R
2,093,002 A * 9/1937 Bouwers ..... H01J 35/02 250/399
(Continued)

FOREIGN PATENT DOCUMENTS

CN 2746516 Y 12/2005
CN 1938811 A 3/2007
(Continued)

OTHER PUBLICATIONS

Combined Chinese Office Action and Search Report dated Sep. 4, 2017 in Patent Application No. 201610394736.0 (with English language translation).

*Primary Examiner* — Anastasia Midkiff
(74) *Attorney, Agent, or Firm* — Oblon, McClelland, Maier & Neustadt, L.L.P.

(57) ABSTRACT

According to one embodiment, an X-ray tube includes a cathode including a filament, an anode target, and an envelope. The cathode includes a metal lead wire supporter which is exposed outside the envelope, which is configured as a part of the envelope, and to which a lead wire as a power supplier to the filament is attached such that the lead wire passes both inside and outside of the envelope, and a metal filament supporter fixed on the lead wire supporter, being in contact with the lead wire supporter, and supporting the filament.

8 Claims, 2 Drawing Sheets

(51) Int. Cl.

| | |
|---|---|
| ***H01J 19/48*** | (2006.01) |
| ***H01J 29/90*** | (2006.01) |
| ***H01J 35/16*** | (2006.01) |
| ***H05G 1/10*** | (2006.01) |
| ***H01J 19/66*** | (2006.01) |
| ***H01J 5/22*** | (2006.01) |
| ***H01J 19/60*** | (2006.01) |
| ***H01J 29/92*** | (2006.01) |
| *H01J 35/06* | (2006.01) |

(52) U.S. Cl.
CPC ..... *H01J 19/48* (2013.01); *H01J 19/60* (2013.01); *H01J 19/66* (2013.01); *H01J 29/90* (2013.01); *H01J 29/92* (2013.01); *H01J 35/06* (2013.01); *H01J 2235/023* (2013.01); *H01J 2237/032* (2013.01); *H01J 2237/166* (2013.01); *H01J 2893/0008* (2013.01); *H05G 1/10* (2013.01)

(58) Field of Classification Search
CPC ..... H01J 1/90; H01J 1/92; H01J 1/94; H01J 1/96; H01J 3/00; H01J 3/02; H01J 3/021; H01J 3/027; H01J 5/00; H01J 5/02; H01J 5/18; H01J 5/20; H01J 5/22; H01J 5/24; H01J 5/26; H01J 5/28; H01J 5/32; H01J 5/40; H01J 5/46; H01J 5/48; H01J 5/50; H01J 5/52; H01J 5/54; H01J 9/00; H01J 9/02; H01J 9/04; H01J 9/08; H01J 9/10; H01J 9/42; H01J 9/44; H01J 9/46; H01J 9/48; H01J 9/50; H01J 9/54; H01J 9/58; H01J 9/60; H01J 9/62; H01J 9/64; H01J 9/66; H01J 21/00; H01J 21/02; H01J 21/36; H01J 23/00; H01J 23/02; H01J 23/04; H01J 23/06; H01J 23/12; H01J 23/14; H01J 31/50; H01J 29/00; H01J 29/02; H01J 29/04; H01J 29/46; H01J 29/48; H01J 29/481; H01J 29/485; H01J 29/86; H01J 29/861; H01J 29/864; H01J 29/90; H01J 29/92; H01J 35/00; H01J 35/02; H01J 35/04; H01J 35/06; H01J 35/065; H01J 35/16; H01J 35/165; H01J 2201/00; H01J 2201/34; H01J 2201/342; H01J 2203/00; H01J 2203/02; H01J 37/00; H01J 37/02; H01J 37/04; H01J 37/06; H01J 37/065; H01J 37/073; H01J 37/16; H01J 37/18; H01J 37/24; H01J 37/242; H01J 37/248; H01J 2235/00; H01J 2235/02; H01J 2235/023; H01J 2235/06; H01J 2235/16; H01J 2235/163; H01J 2237/00; H01J 2237/02; H01J 2237/03; H01J 2237/032; H01J 2237/036; H01J 2237/06; H01J 2237/061; H01J 2237/063; H01J 2237/06325; H01J 2237/06333; H01J 2237/06375; H01J 2237/16; H01J 2237/166; H01J 2237/18; H01J 2237/182; H01J 2237/184; H01J 2893/00; H01J 2893/0001; H01J 2893/0002; H01J 2893/0005; H01J 2893/0006; H01J 2893/0008; H01J 2893/0012; H01J 2893/0013; H01J 2893/0029; H01J 2893/0033; H01J 2893/0048; H01J 2893/0049; H01J 2893/005; H05G 1/00; H05G 1/02; H05G 1/04; H05G 1/08; H05G 1/10
See application file for complete search history.

(56) References Cited

U.S. PATENT DOCUMENTS

| | | | | | |
|---|---|---|---|---|---|
| 2,119,069 | A * | 5/1938 | Bouwers | H01J 35/02 | 378/139 |
| 2,226,653 | A * | 12/1940 | Allerding | H01J 21/36 | 174/14 R |
| 3,107,311 | A * | 10/1963 | Gray | H01J 35/02 | 250/399 |
| 4,274,005 | A * | 6/1981 | Yamamura | A61B 6/032 | 378/10 |
| 6,236,713 | B1 * | 5/2001 | True | H01J 3/12 | 378/136 |
| 2007/0211862 | A1 * | 9/2007 | Ito | H01J 9/26 | 378/140 |

FOREIGN PATENT DOCUMENTS

| | | | |
|---|---|---|---|
| CN | 201402789 | Y | 2/2010 |
| CN | 103390533 | A | 11/2013 |
| EP | 0 141 041 | B1 | 1/1990 |
| JP | 59-16063 | U | 1/1984 |
| JP | 10-172482 | A | 6/1998 |

* cited by examiner

X-RAY TUBE INCLUDING SUPPORT FOR LATITUDE SUPPLY WIRES

CROSS-REFERENCE TO RELATED APPLICATIONS

This application is based upon and claims the benefit of priority from Japanese Patent Application No. 2015-117322, filed Jun. 10, 2015, the entire contents of which are incorporated herein by reference.

FIELD

Embodiments described herein relate generally to an X-ray tube.

BACKGROUND

In X-ray tubes, the position of a filament with respect to a cathode cup must be controlled precisely to control the dimensions of the focal point of the X-rays. Conventionally, a filament is fixed to the cathode cup via an insulating member using steatite, ceramic, etc.

Lead wires are passed into a glass member of an envelope to supply electricity from outside of the X-ray tube to the filament. One or two lead wires are connected to the filament while the other lead wires are fixed to a cathode cover which supports the cathode cup.

During operation of the X-ray tube, the filament reaches a temperature of over 2000° C. Thus, cathode components in the proximity of the filament such as the cathode cup are heated by radiant heat from the filament. In most cases, the heat of the cathode cup transfers to the cathode cover and is released outside of the X-ray tube via the lead wires. Generally, a lead wire has a diameter of 1 to 2 mm and a length of 10 to 20 mm, and thus the cathode cup is nearly vacuum insulated. Therefore, the heat of the filament tends to increase the temperature of the cathode cup. From observation, the temperature of the cathode cup has been found to reach over 200° C. when the filament power is approximately 10 W.

The filament must be heated to a high temperature for the emission of thermoelectrons, while the other cathode components are desired to be kept at a low temperature to suppress the emission of gas inside the envelope. The desorption of the gas around the filament, which reaches an extremely high temperature, occurs in a short period; however, the desorption of the gas around the cathode components, which reach several hundreds of degrees centigrade, occurs slowly, and the emission of the gas is maintained over a long period such that the vacuum in the envelope is gradually degraded.

DETAILED DESCRIPTION

In general, according to one embodiment, there is provided an X-ray tube comprising: a cathode including a filament which emits an electron beam, an anode target on which the electron beam is incident and from which X-rays are emitted, and an envelope which accommodates the cathode and the anode target. The cathode includes a metal lead wire supporter which is exposed outside the envelope, which is configured as a part of the envelope, and to which a lead wire as a power supplier to the filament is attached such that the lead wire passes both inside and outside of the envelope, and a metal filament supporter fixed on the lead wire supporter, being in contact with the lead wire supporter, and supporting the filament.

Hereinafter, a first embodiment will be explained with reference to FIGS. 1 and 2.

Figure 1:
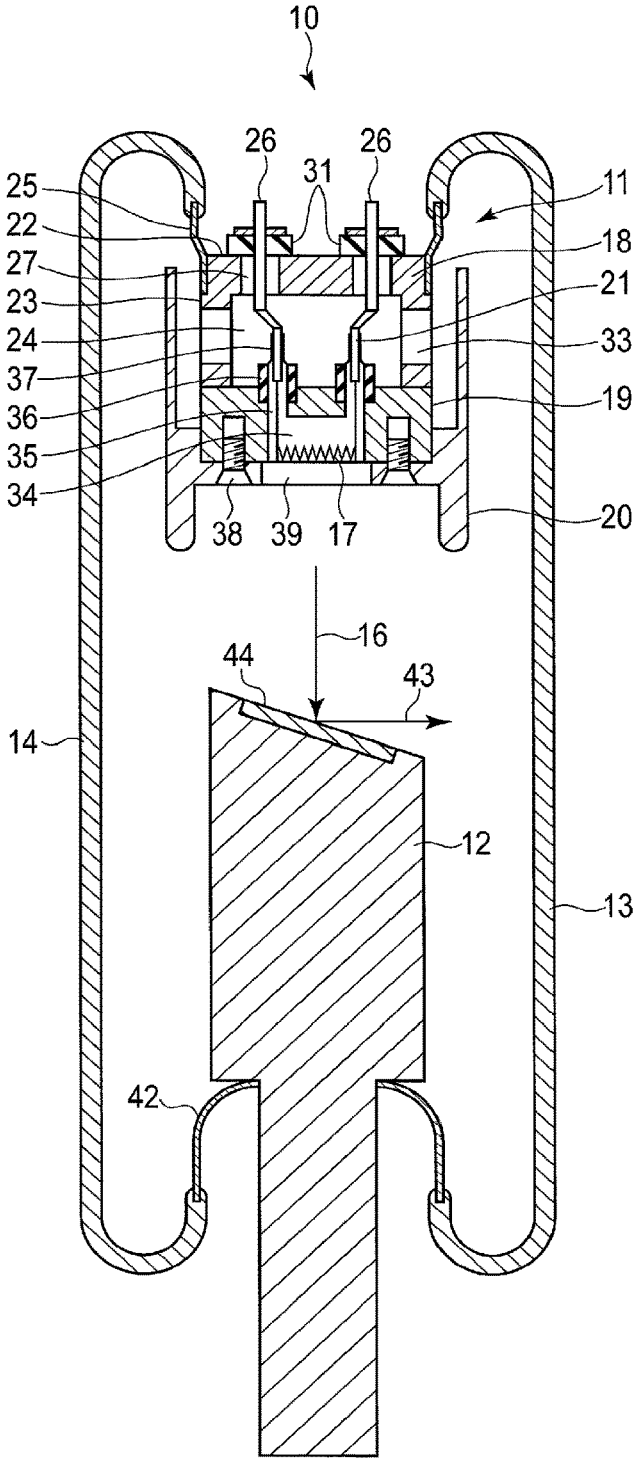
FIG. 1 is a cross-sectional view of an X-ray tube of a first embodiment.
Figure 2:
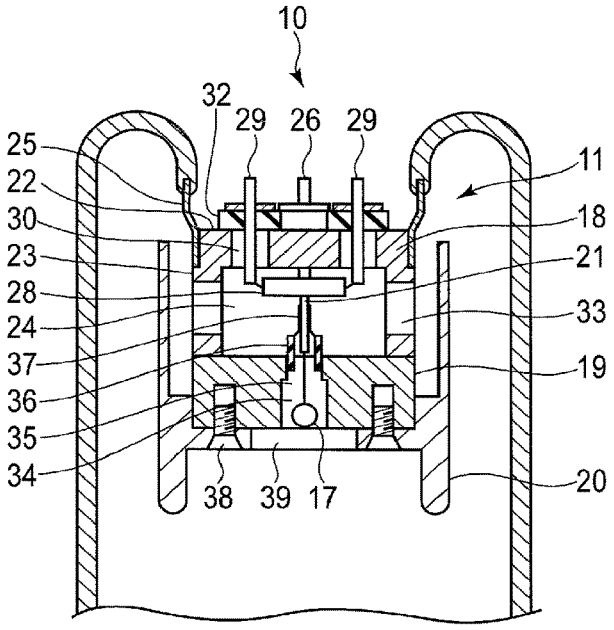
FIG. 2 is another cross-sectional view of the X-ray tube.

As shown in FIGS. 1 and 2, an X-ray tube 10 is a stationary anode X-ray tube and includes a cathode 11, anode target 12, and envelope 13 which accommodates the cathode 11 and the anode target 12. The envelope 13 includes a cylindrical glass body 14, and the cathode 11 is sealed in one end of the body 14 while the anode target 12 is sealed in the other end of the body 14. The inside of the envelope 13 is kept under vacuum.

Furthermore, the cathode 11 includes a filament 17 which emits an electron beam 16, and further includes a lead wire supporter 18, filament supporter 19, and cathode cup 20 as a focusing electrode.

The filament 17 is electrically connected to a pair of filament terminals 21 via both ends thereof, and is supported by the filament supporter 19 via the pair of filament terminals 21.

The lead wire supporter 18 is formed of a metal and is cylindrical, being coaxial with the central axis of the X-ray tube 10. The lead wire supporter 18 includes an edge surface 22 and a circumferential surface 23. A space 24 is provided in an inside of the lead wire supporter 18. One end of the envelope 13 and the outer periphery of the lead wire supporter 18 are connected to each other in a vacuum-tight manner by a cylindrical connector 25. The edge surface 22 of the lead wire supporter 18 is exposed outside the envelope 13.

Through-holes 27 and through-holes 30 are formed in the lead wire supporter 18, and are opened in the edge surface 22. A pair of lead wires 26 are electrically connected to the pair of filament terminals 21, and are passed through the through-holes 27. If a getter 28 is provided with the space 24, a pair of lead wires 29 are electrically connected to both ends of the getter 28, and are passed through the through-holes 30. The through-holes 27 and 30 are closed by insulating closers 31 and 32, respectively. The lead wires 26 and 29 are passed through the closers 31 and 32, and are attached in a vacuum-tight manner, respectively. Thus, the lead wire supporter 18 supports the lead wires 26 and 29 in an electrically insulating manner.

The filament terminals 21 and lead wires 26 are inserted in the space 24 in the lead wire supporter 18 such that the filament terminals 21 and the lead wires 26 are attached to each other directly or by means of an interconnecting component such as another lead wire interposed therebetween and the attachment is achieved by welding or the like.

The circumferential surface 23 of the lead wire supporter 18 includes an opening 33 which is a hole or a cut-out. The opening 33 is opposed to the attachment point of the filament terminals 21 and the lead wires 26 to be, for example, welded. Through the opening 33, an attachment operation of the filament terminals 21 and the lead wires 26 can be performed.

The filament supporter 19 is formed of a metal and in a cylindrical shape, and is coaxial with the central axis of the X-ray tube 10. The filament supporter 19 is fixed to the lead wire supporter 18 to at least partly make a surface contact therewith. Thus, good thermal conductivity is secured between the filament supporter 19 and the lead wire supporter 18.

The filament supporter 19 includes a recess 34 to accommodate the filament 17, and a pair of holes 35 through which both ends of the filament 17 are passed. Insulating cylinders 36 are attached to the holes 35 and sleeves 37 to which the filament terminals 21 are attached to the cylinders 36 and are fixed to the cylinders 36. Therefore, the filament supporter 19 supports the filament 17 in an electrically insulating manner.

Furthermore, the cathode cup 20 is formed of a metal and is cylindrical, being coaxial with the central axis of the X-ray tube 10. The cathode cup 20 is fixed to the filament supporter 19 by screws 38 to at least partly make a surface contact with the filament supporter 19. Thus, good thermal conductivity is secured between the filament supporter 19 and the cathode cup 20. The cathode cup 20 includes a window aperture 39 through which the filament 17 is exposed.

Furthermore, the anode target 12 and the other end of the envelope 13 are connected to each other in a vacuum-tight manner by a cylindrical connecter 42. The anode target 12 includes a target surface 44 on which the electron beam 16 from the cathode 11 is incident and a focal point of emission of X-rays (X-ray beam) 43 is formed.

During the operation of the X-ray tube 10, the filament 17 is used in a temperature over 2000° C. to emit thermoelectrons. On the other hand, the other cathode components such as the cathode cup 20 should be kept at a lower temperature to suppress the emission of gas inside the envelope 13.

The cathode components such as cathode cup 20 in the proximity of the filament 17 are heated by the radiant heat from the filament 17, and the temperature of the cathode components rises.

The cathode cup 20 is fixed to the filament supporter 19, and the filament supporter 19 is fixed to the lead wire supporter 18. Good thermal conductivity is secured between the cathode cup 20 and the filament supporter 19, and also between the filament supporter 19 and the lead wire supporter 18, and the edge surface 22 of the lead wire supporter 18 is exposed outside the envelope 13. Thus, a sufficient heat dissipation path from the cathode cup 20 and the filament supporter 19 to the outside of the envelope 13 (in the air or in an insulating medium) is achieved in the tube. Therefore, an increase in the temperature of the cathode cup 20 and the filament supporter 19 can be suppressed.

Therefore, the heat dissipation efficiency of the cathode cup 20, filament supporter 19, and the like can be improved to suppress an increase in the temperature thereof, and gas produced inside the envelope 13 during a long period of operation can be suppressed to prevent the vacuum inside the envelope 13 from being degraded.

Furthermore, as to the fixation of the filament supporter 19 to the lead wire supporter 18, an attachment point of the filament terminals 21 to the lead wires 26 is positioned inside the lead wire supporter 18 to correspond to the opening 33 on the side surface of the lead wire supporter 18. Thus, through the opening 33, attachment of the filament terminals 21 to the lead wires 26 can be performed.

Note that, depending on the structure of the lead wire supporter 18 and the filament supporter 19, an opening for the attachment of the filament terminals 21 to the lead wires 26 may be provided with the filament supporter 19.

Figure 3:
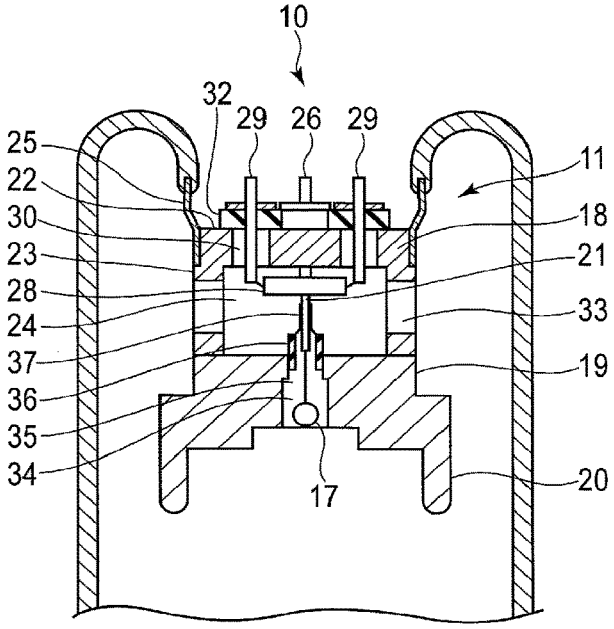
FIG. 3 is a cross-sectional view of an X-ray tube of a second embodiment.

Now, a second embodiment will be explained with reference to FIG. 3. The same components as in the first embodiment will be referred to by the same reference numbers, and explanation of their specific structures and effects will be omitted.

In this embodiment, a filament supporter 19 and a cathode cup 20 are formed integrally. That is, the filament supporter 19 has a function of focusing an electron beam 16 emitted from a filament 17.

Structured as above, the number of components used in the X-ray tube can be reduced, and the heat dissipation efficiency can be further improved.

Note that the X-ray tube of the embodiments is not limited to a stationary anode X-ray tube, but may be a rotation anode X-ray tube.

Furthermore, the body of the envelope of the X-ray tube of the embodiments is mainly formed of glass; however, no limitation is intended thereby. The body may be formed of a ceramic or a metal.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray tube comprising:

a cathode including a filament which emits an electron beam;

a lead wire as a power supplier to the filament;

an anode target on which the electron beam is incident and from which X-rays are emitted; and an envelope which accommodates the cathode and the anode target, wherein the cathode includes a lead wire supporter which is exposed outside the envelope, which is connected to the envelope in a vacuum-tight manner, which supports the lead wire, and which is formed of metal, and a filament supporter fixed on the lead wire supporter, being in contact with the lead wire supporter, supporting the filament, and which is formed of metal, and the lead wire is attached to the lead wire supporter via an insulator in a vacuum-tight manner, and passes both inside and outside of the envelope.

2. The X-ray tube of claim 1, wherein the cathode includes a metal focusing electrode which is fixed on the filament supporter to make a contact therewith and is configured to focus the electron beam emitted from the filament.

3. The X-ray tube of claim 2, wherein one of the lead wire supporter and the filament supporter is cylindrical and has an opening on a side surface thereof, a filament terminal fixed to the filament and the lead wire are inserted inside of said one of the lead wire supporter and the filament supporter, and the filament terminal and the lead wire are connected to each other to be opposed to the opening.

4. The X-ray tube of claim 1, wherein the filament supporter focuses the electron beam emitted from the filament.

5. The X-ray tube of claim 4, wherein one of the lead wire supporter and the filament supporter is cylindrical and has an opening on a side surface thereof, a filament terminal fixed to the filament and the lead wire are inserted inside of said one of the lead wire supporter and the filament supporter, and the filament terminal and the lead wire are connected to each other to be opposed to the opening.

6. The X-ray tube of claim 1, wherein the filament is supported by the filament supporter in an electrically insulated manner.

7. The X-ray tube of claim 6, wherein one of the lead wire supporter and the filament supporter is cylindrical and has an opening on a side surface thereof, a filament terminal fixed to the filament and the lead wire are inserted inside of said one of the lead wire supporter and the filament supporter, and the filament terminal and the lead wire are connected to each other to be opposed to the opening.

8. The X-ray tube of claim 1, wherein one of the lead wire supporter and the filament supporter is cylindrical and has an opening on a side surface thereof, a filament terminal fixed to the filament and the lead wire are inserted inside of said one of the lead wire supporter and the filament supporter, and the filament terminal and the lead wire are connected to each other to be opposed to the opening.

* * * * *